US005911288A

United States Patent [19]

Zafirakis

[11] Patent Number: 5,911,288

[45] Date of Patent: Jun. 15, 1999

[54] BRIDGE PAINTING PLATFORM

[75] Inventor: Gregory Zafirakis, East Amherst, N.Y.

[73] Assignee: Z.A.F. Contractors, Inc., Lancaster, N.Y.

[21] Appl. No.: 08/740,892

[22] Filed: Nov. 4, 1996

[51] Int. Cl.[6] ..... E04G 3/10

[52] U.S. Cl. ..... 182/150

[58] Field of Search ..... 182/36, 62.5, 130, 182/141, 142, 145, 150, 222, 223

[56] References Cited

U.S. PATENT DOCUMENTS

| | | | |
|---|---|---|---|
| 1,702,509 | 2/1929 | Johnston | 182/130 X |
| 1,725,183 | 8/1929 | Fischer | 182/130 X |
| 2,057,092 | 10/1936 | Geib | 182/150 X |
| 2,851,311 | 9/1958 | Gibbs | 182/130 X |
| 3,023,834 | 3/1962 | Buchanan | 182/223 |
| 3,524,520 | 8/1970 | Tidwell | 182/150 X |
| 3,945,462 | 3/1976 | Griswold | 182/150 |
| 4,349,297 | 9/1982 | Misener | 182/222 X |
| 4,445,590 | 5/1984 | Ihrman | 182/222 |
| 4,499,967 | 2/1985 | Anderson | 182/145 X |
| 4,660,680 | 4/1987 | Potin | 182/150 X |
| 4,811,530 | 3/1989 | Eyerly | 182/222 X |
| 4,854,419 | 8/1989 | Lyras et al. | 182/150 X |
| 5,011,710 | 4/1991 | Harrison | 182/150 X |
| 5,143,173 | 9/1992 | Lubinski | 182/222 X |
| 5,299,655 | 4/1994 | Margaritis | 182/150 X |
| 5,678,654 | 10/1997 | Uzawa | 182/130 X |

*Primary Examiner*—Daniel P. Stodola
*Assistant Examiner*—Richard M. Smith
*Attorney, Agent, or Firm*—Simpson, Simpson & Snyder

[57] ABSTRACT

A work platform for temporary installation under a bridge span includes a plurality of longitudinal support cables supporting transversely extending grating planks, with sidewise adjacent planks being interlocked by lock pins. A selected subset of the grating planks are releasably fastened to underlying support cables T-shaped clamping members inserted through slots in the selected grating planks.

1 Claim, 3 Drawing Sheets

FIG. 3
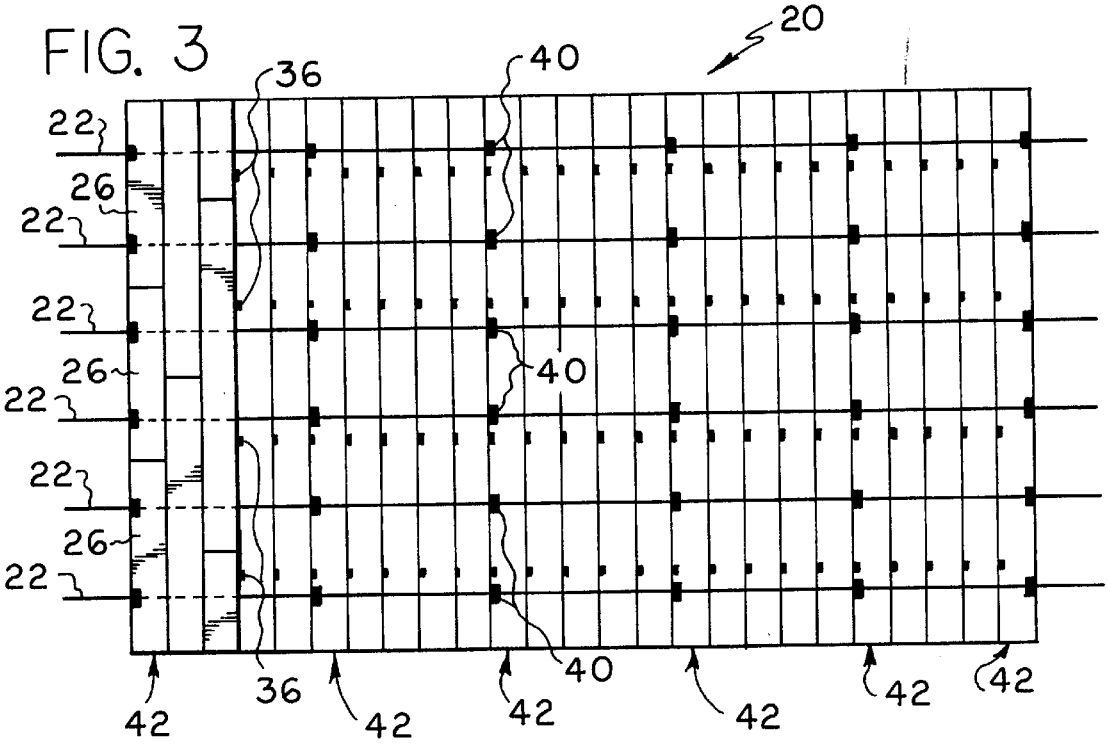
FIG. 4
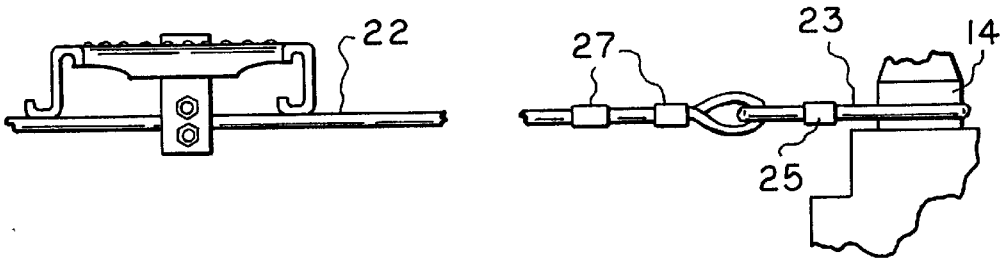
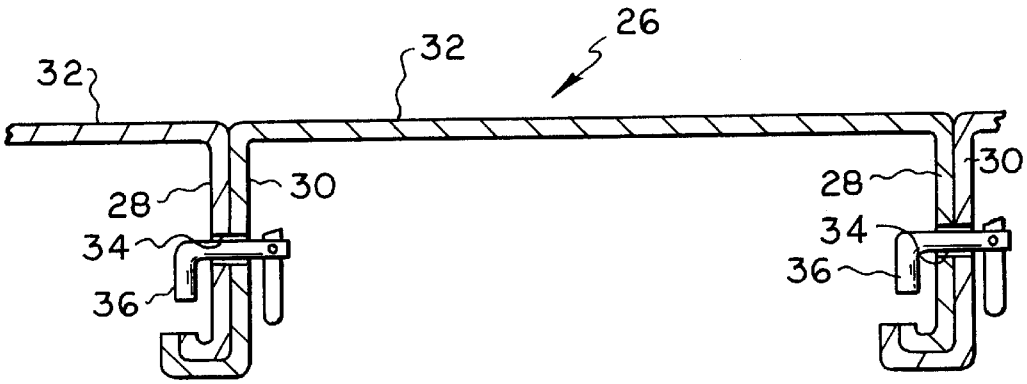
FIG. 5

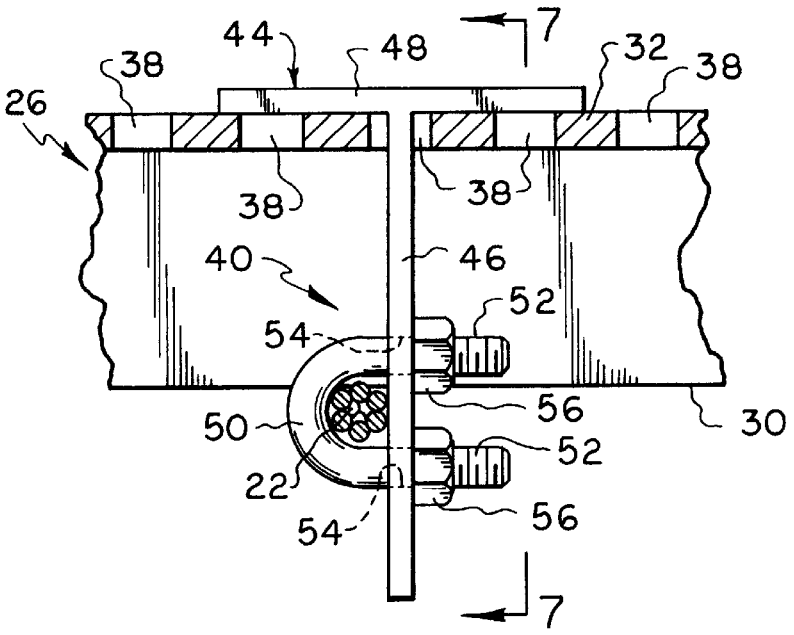
FIG. 6
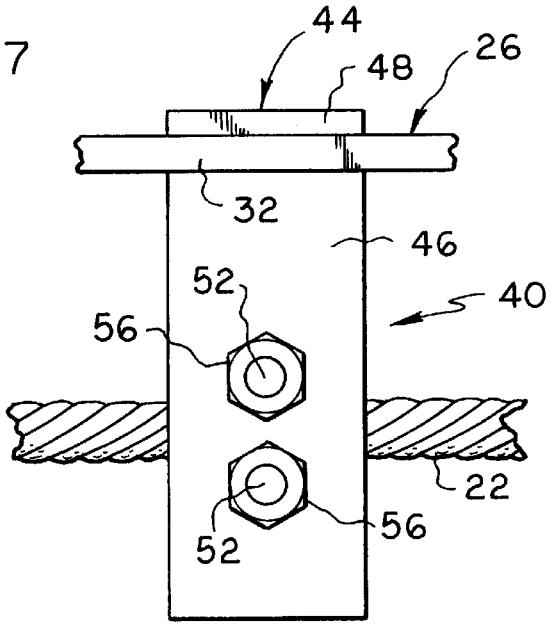
FIG. 7
FIG. 8
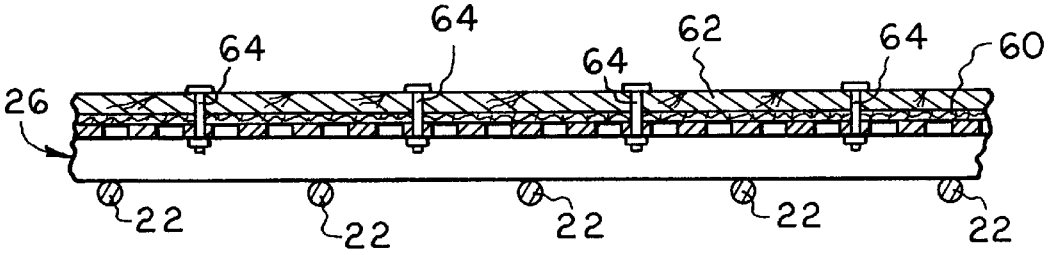

BRIDGE PAINTING PLATFORM

BACKGROUND

A. Field of the Invention

The present invention relates generally to platform installation systems of a temporary nature for supporting workers, and more particularly to an improved platform system for supporting workers beneath a bridge span to permit painting, sandblasting, and other restoration work involving the bridge span substructure to be conducted.

B. Description of the Prior Art

In the maintenance or restoration of a bridge span, for example a highway overpass, it is necessary to provide a platform for supporting workers beneath the span to allow easy access to the substructure of the bridge span, thereby enabling the workers to perform such tasks as sandblasting, painting, and repairing structural elements.

A longtime and widely-used system for erecting a temporary platform beneath a bridge span includes the use of ground-supported scaffold towers bearing a plurality of spaced support beams secured thereto, and rectangular boards fixed on top of the support beams to provide a platform floor surface. This type of system may be undesirable where traffic on a highway traversed by the bridge span must be restricted and/or pass closely by one or more of the scaffold towers. Also, this type of system is impractical where sufficient ground area beneath the bridge span is unavailable, for instance where the bridge span traverses a body of water.

As an alternative to scaffold platform systems of the type described above, suspended platform systems have been developed which are supported by the bridge structure itself. A typical suspended system includes a first group of longitudinally spaced, transversely extending support beams suspended from bridge structural beams on the underside of the bridge span by vertical cables, a second group of spaced support beams orthogonally overlying the first group and fixed thereto, and rectangular boards secured in place on the second group of support beams to provide a suitable platform floor surface.

An enclosed, cable-supported workplace platform for temporary installation beneath a bridge span is taught by Margaritis in U.S. Pat. No. 5,299,655 issued Apr. 5, 1994. The platform of Margaritis includes, in part, opposing sets of outriggers extending from opposite lateral sides of the bridge span, a plurality of spaced support cables each secured to a set of outriggers or to existing bridge supports so that the cables extend parallel to a centerline of the bridge span, an open-link flooring rolled out over the cables and clipped thereto, and a flexible fabric tarp overlying the open-link flooring and clipped to the cables and/or lateral side portions of the open-link flooring. The platform system of Margaritis specifies chain-link fencing for use as flooring, however this results in considerable sagging or flexing of the platform as weight is applied.

SUMMARY OF THE INVENTION

In view of the prior art platform systems mentioned above, it is a primary object of the present invention to provide a suspended platform system for installation beneath a bridge span which does not require rigid support beams supported from the ground, yet which provides a relatively rigid platform floor surface connected to support cables.

It is another object of the present invention to provide a modular platform system of interlocked planks which is easily adapted to fit under various bridge spans of different sizes and configurations.

It is a further object of the present invention to provide a platform system which may be installed and removed in an efficient and orderly manner.

It is a further object of the present invention to provide a platform system which may be relocated plank-by-plank to a new location.

By way of summary, the platform system of the present invention includes a plurality of transversely spaced support cables secured at opposite ends thereof to bridge supports to extend longitudinally beneath the bridge span, with vertical cables located at spaced intervals along the support cables to connect the support cables to overhead bridge support beams. A plurality of elongated grating planks overlie the support cables and are arranged end-to-end to reach a desired width between lateral sides of the bridge span and side-by-side to reach a desired length between the bridge supports. Sidewise adjacent planks are releasably interlocked by lock pins located matched sides of the planks. A selected subset of planks are releasably fastened to underlying support cables by T-shaped clamping members insertable through slots in the grating planks to complete the platform. Tarp sheets held in place by plywood boards may be set overtop the interlocked planks and the boards securely bolted to the planks to provide a dust sealing platform.

BRIEF DESCRIPTION OF THE DRAWINGS

The nature and mode of operation of the present invention will now be more fully described in the following detailed description of the preferred embodiments taken with the accompanying drawing figures, in which:

FIG. 3 is a top schematic view of the bridge platform of the present invention;

FIG. 4 is a side elevational view showing attachment of a support cable of the platform to a bridge support;

FIG. 5 is a partial cross-sectional view showing a pair of sidewise adjacent planks of the platform interlocked along matched sides thereof;

FIG. 6 is a partial cross-sectional view of a grating plank of the bridge platform showing means for releasably fastening the plank to an underlying support cable;

FIG. 7 is another view of the fastening means taken generally along the line 7—7 in FIG. 6; and FIG. 8 is a cross-sectional view showing a further embodiment of the present invention.

DETAILED DESCRIPTION OF THE PREFERRED EMBODIMENTS

Figure 1:
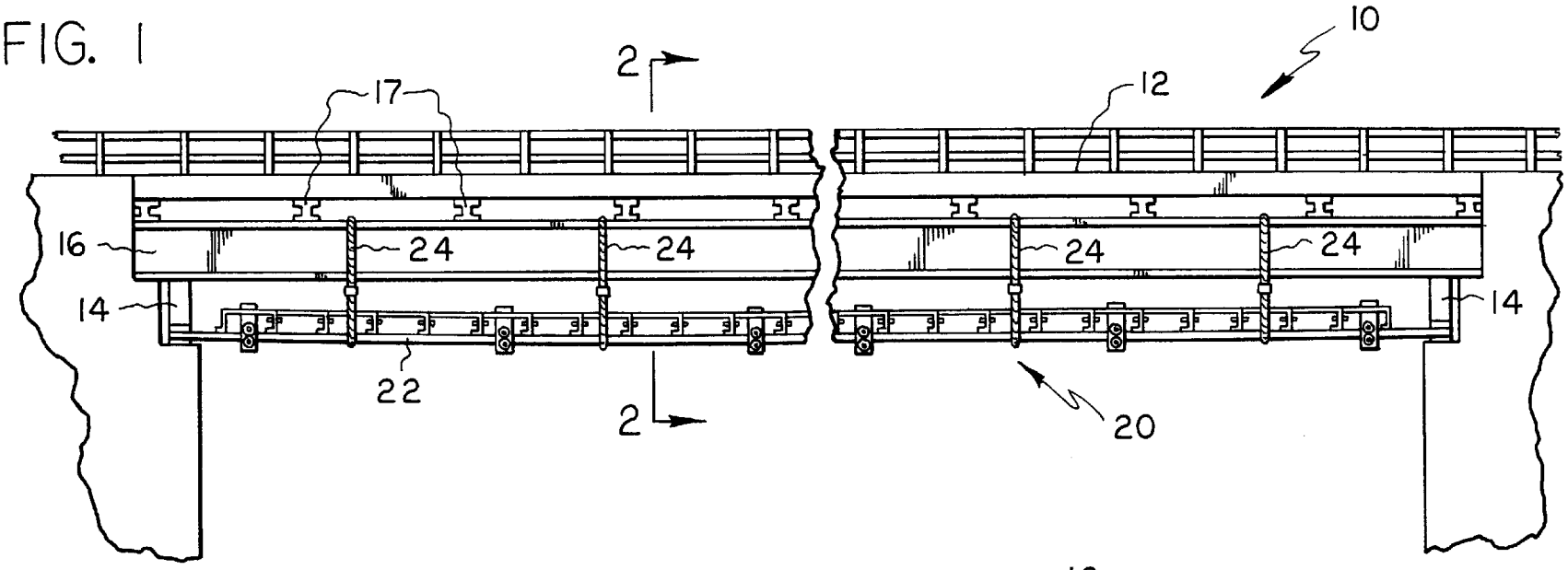
FIG. 1 is a side elevational view of a bridge with a bridge platform installed thereunder in accordance with a preferred embodiment of the present invention.
Figure 2:
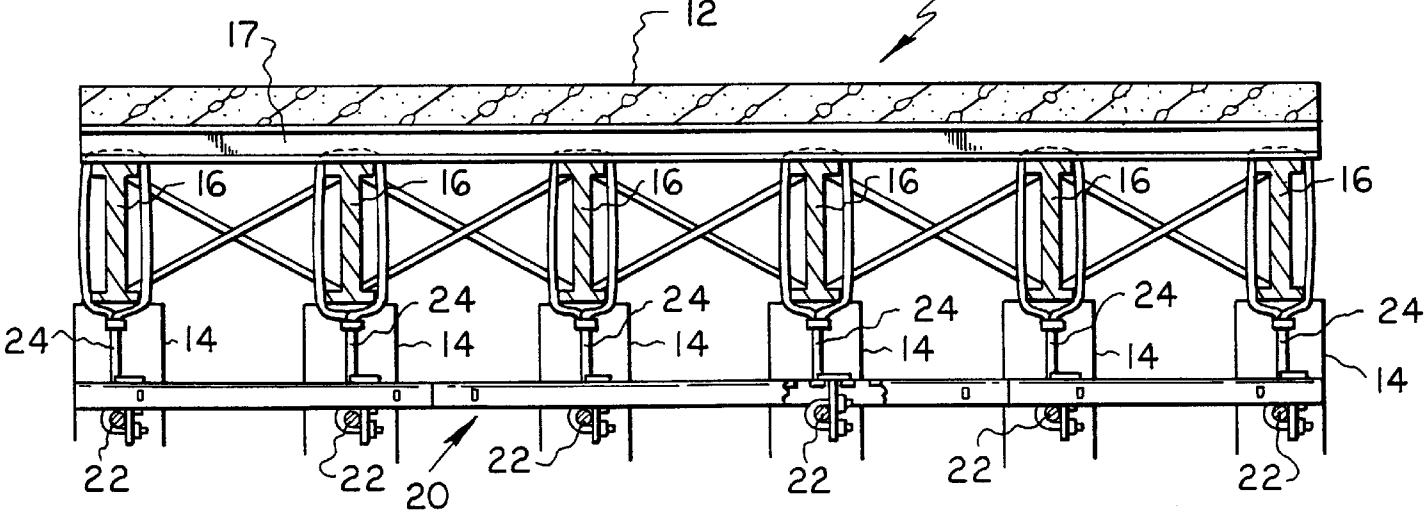
FIG. 2 is a cross-sectional view of the bridge and bridge platform taken generally along the line 2—2 in FIG. 1.

Referring initially to FIGS. 1 and 2, there is shown a bridge span generally identified as 10 which includes a roadway 12, a plurality of paired vertical bridge supports 14 at opposite ends of the span, a plurality of transversely spaced support beams 16 extending longitudinally between bridge supports 14, and a plurality of spaced cross-beams supported by support beams 16 to extend transversely of the span as part of the supporting substructure for roadway 12. There is also shown a bridge work platform generally identified as 20 installed a predetermined distance, preferably about five feet beneath support beams 16 in accordance with the present invention to support a plurality of workers for access to the substructure of bridge span 10. Platform 20 is intended to provide a temporary, safe, and sturdy workplace for workers engaged in construction, sand blasting, painting, structural repair, and the like, involving the substructure of bridge span 10. Platform 20 of the present invention may be customized to fit a variety of differently-sized bridge spans according to need.

Referring also now to FIGS. 3 and 4, platform 20 includes a plurality of generally parallel support cables 22 extending in the longitudinal direction of span 10 and having opposite ends thereof secured to bridge supports 14, and a plurality of vertical cables 24 each attached at one end to an overhead support beam 16 an at another end to an associated support cable 22. In the present example, support cables 22 are spaced transversely of the bridge span at approximately 7 foot intervals, and vertical cables 24 are provided approximately every 20 feet along an associated support cable 22. FIG. 4 illustrates attachment of a support cable 22 to a bridge support 14, which may be accomplished by providing a wire rope sling 23 arranged about the bridge support and using a thimble shackle 25 in combination with a series of adjustable wire rope clips 27 to securely connect the support cable 22 to wire rope sling 23. Opposite ends of vertical cables 24 may be connected in a similar manner to an associated support cable 22 and a support beam 16 of bridge span 10. Cables 22 and 24, along with slings 23, shackles 25, and clips 27, are carefully chosen to provide sufficient strength under the combination of "dead load" due to the platform weight itself; "live load" due to the weight of a work crew, equipment, and sand blasting grit material removed from bridge span 10; and wind load. Those skilled in the art will recognize that a slight sag should be maintained in support cables 22 between vertical cables 24 to avoid severe tensioning of the support cables.

The flooring of platform 20 is composed of a plurality of rigid grating planks 26 overlying support cables 22, with metal grating planks manufactured by McNichols Company of Tampa, Fla. and sold under the trademark THE HOLE STORY® being suitable for practicing the present invention. A preferred plank as described herein is available from McNichols Company under specification no. MG-121518-FM. As best seen in FIG. 3, planks 26 are arranged end-to-end in columns to extend a desired distance in a transverse direction, and side-by-side in rows to extend a desired distance in a longitudinal direction. The length of each plank 26 is preferably chosen such that each plank overlies and is supported by at least three different support cables 22. For example, each column of planks may include an ordered series of three planks of different lengths, namely 18', 20', and 22', with sidewise adjacent columns set in reverse order to stagger break lines between planks from one column to the next. Small cut-out portions (not shown) may be provided in planks 26 as needed to accommodate vertical cables 24.

As best shown in FIG. 5, planks 26 include male and female generally J-shaped side flanges 28 and 30, respectively, extending downward from opposite side edges of a horizontal portion 32 of each plank, with male side flange 28 being sized for releasable interlocked mating within a female side flange 30 of a sidewise adjacent plank. Flanges 28 and 30 are provided with regularly-spaced alignable holes 34 running the length thereof for receiving lock pins 36, for example a BIL-JAX® scaffold lock pin, to hold the mated flanges in their interlocked relationship. FIG. 3 shows the preferred placement of lock pins 36 approximately every 10 feet in the transverse direction between sidewise adjacent planks 26 of platform 20, with each plank 26 receiving at least two lock pins 36.

Referring to FIG. 6, each plank 26 further includes a plurality of slot openings 38 through horizontal portion 32 extending between side flanges 28 and 30, such that slot openings 38 run in the same longitudinal direction of span 10 as underlying support cables 22. Slot openings may be spaced regularly at close intervals along substantially the entire length of each plank 26 so as to ensure that each support cable 22 is generally underneath a corresponding slot opening 38 of each plank 26 supported thereby, or slot openings may be custom cut. As will be understood, each support cable 22 underengages female side flanges 30 of the row of planks 26 which it supports, as well as the male side flange 28 of a plank at the beginning of such row.

In accordance with the present invention, means are provided for releasably fastening a selected subset of planks 26 to underlying support cables 22. In the preferred embodiment, such means comprises a plurality of clamping mechanisms generally identified as 40 and described in detail below. Clamping mechanisms 40 are preferably provided in every fifth plank along each support cable 22, such that the planks in selected plank columns 42 form a subset of planks 26 which are releasably fastened to underlying support cables 22. The interlocking of sidewise adjacent planks as described above avoids the need for releasably fastening every plank of platform 20 to each of its underlying support cables, thereby simplifying installation and removal of platform 20.

Referring now to FIGS. 6 and 7, clamping mechanism 40 includes a rigid T-shaped member 44, preferably formed of steel bar stock, having a vertical leg 46 sized to extend through a chosen slot opening 38 in plank 26 for surface engagement with an underlying support cable 22, and a horizontal leg 48 sized to engage horizontal portion 32 of plank 26 to prevent T-shaped member 44 from falling through slot opening 38. Clamping mechanism 40 further includes a horizontally disposed U-bolt 50 having legs 52 intended for receipt through vertically spaced bolt holes 54 in vertical leg 46. U-bolt 50 fits around support cable 22 and, when secured by nuts 56, serves to releasably clamp the support cable to vertical leg 46 and thereby fasten plank 26 to support cable 22.

FIG. 8 shows a further embodiment of the present invention useful as part of a sealed environment to contain debris and sandblasting waste. This embodiment is the same as that described above, however it further includes a plurality of sheets of translucent plastic tarp 60 laid over planks 26 and sandwiched in place by a plurality of plywood boards 62 fastened to planks 26 by bolts 64.

To install platform 20 of the present invention, wire rope slings 23 are placed about bridge supports 14, opposite ends of support cables 22 are connected to associated slings 23 by shackles 25 and clips 27, and support cables 22 are stretched to a predetermined safe tension. After support cables 22 are in place, a first column 42 of three planks 26 is laid in place over the support cables near an end of the span and fastened to the support cables by clamping mechanisms 40 provided at each support cable location. With the first column in place, platform 20 is constructed in a longitudinally progressive manner along the span by laying planks 26 side-by-side in interlocked relationship, providing lock pins 36 as previously described between sidewise adjacent planks. Every fifth plank 26 is fastened to underlying support cables 22 by clamping mechanisms 40, and vertical cables 24 are installed at regular intervals along each support cable 22 as platform 20 progresses from one end of the span to the other. The planks in a last column 42 are fastened to underlying support cables 22 using clamping mechanisms 40 to complete the basic platform embodiment. Where the embodiment of FIG. 8 is desired, tarp sheets 60 and plywood boards 62 may be set in place overtop interlocked planks 26, and the boards securely bolted to the planks.

Removal of platform 20 is accomplished by reversing the installation procedure described in the preceding paragraph. An advantage of the platform system of the present invention is that planks 26 may be selectively installed where needed underneath a portion of bridge span 10, and subsequently moved to another location underneath a different portion of the bridge span upon completion of work at the first location. Relocation of the platform is carried out in a plank-by-plank manner by removing planks 26 from an area on the platform furthest from the new location and installing each removed plank at an area of the new location proximate to the remaining existing platform. In this way, the existing platform may be used to transport planks removed therefrom to the new location.

What is claimed is:

1. A workplace platform system for temporary installation beneath a bridge span, said platform system comprising:

a plurality of transversely spaced support cables secured to extend longitudinally beneath said span;

a plurality of elongated transversely extending grating planks supported by said support cables, said planks being arranged end-to-end to reach a desired width and side-by-side to reach a desired length;

means for releasably interlocking sidewise adjacent ones of said planks along matched sides thereof; and means for releasably fastening a selected subset of said plurality of planks to underlying ones of said plurality of support cables;

a tarpaulin overlaying said plurality of planks, and a plurality of boards overlaying said tarpaulin, said plurality of boards being bolted to selected underlying ones of said plurality of planks.

* * * * *